United States Patent [19]

Lemons

[11] Patent Number: 5,070,864

[45] Date of Patent: Dec. 10, 1991

[54] BODY MASSAGE APPARATUS

[76] Inventor: David H. Lemons, 1807 Elkhart Dr., Greensboro, N.C. 27408

[21] Appl. No.: 560,557

[22] Filed: Jul. 30, 1990

[51] Int. Cl.[5] ..... A61H 9/00

[52] U.S. Cl. ..... 128/66; 128/65; 239/383

[58] Field of Search ..... 128/68, 66, 65, 38, 128/24.1; 285/396, 401, 402; 239/102.1, 383

[56] References Cited

U.S. PATENT DOCUMENTS

| | | | |
|---|---|---|---|
| 1,948,167 | 12/1932 | Cornwell | 128/66 |
| 2,304,616 | 12/1942 | Watson | 128/66 |
| 3,998,390 | 12/1976 | Peterson | 128/66 |
| 4,402,331 | 9/1983 | Taldo | 128/66 |
| 4,441,488 | 4/1984 | Macabee | 128/66 |
| 4,709,691 | 12/1987 | Lemans | 128/66 |

*Primary Examiner*—Robert A. Hafer
*Assistant Examiner*—David J. Kenealy
*Attorney, Agent, or Firm*—Leon Gilden

[57] ABSTRACT

A body massage apparatus includes a cylindrical housing mounting a rigid boss therein, with a rigid conduit extending tangentially aligned with the housing, wherein an eccentrically balanced turbine wheel is mounted within the housing to effect vibration of the housing in use. A top and bottom perforated plate are mounted and secured to the housing orthogonally to the axis defined by the housing. The invention may further include a resilient pad secured to an exterior surface of the housing to enhance use of the organization as a massage apparatus, and further including a pad utilizing massaging tips projecting exteriorly of the pad.

1 Claim, 5 Drawing Sheets

PRIOR ART 23
24
21
22
14
15
12
17
11
16
18
19

BODY MASSAGE APPARATUS

BACKGROUND OF THE INVENTION

1. Field of the Invention

The field of invention relates to body massage apparatus, and more particularly pertains to a new and improved body massage apparatus for use in a showering environment to enhance massage of an individual's body for relief of aches and relaxation of muscles in use.

2. Description of the Prior Art

Various shower organizations have been utilized in the prior art to provide ease of application of the shower spray to an individual, as well as portability in use. Examples of prior art devices include U.S. Pat. No. 4,807,604 to Canela setting forth a scalp massager wherein a helmet is fitted over a user's head, with a shower conduit directed interiorly of the helmet to apply pulsating water over a user's scalp.

U.S. Pat. No. 4,224,700 to Bloys sets forth an apparatus mounted with a drain aperture of a bathing enclosure, with a self-enclosed pump to circulate water from the enclosure through a shower head.

U.S. Pat. No. 4,498,463 to Roming sets forth a water pressure massage and spray apparatus wherein a plurality of axially movable massaging members project from a working surface of a casing of the organization to enhance massaging during use of the organization as a spray head.

U.S. Pat. No. 4,458,676 to Pileggi sets forth a hand-held massager in combination with a spa utilizing a fluid motor mechanically coupled to a reciprocating massage pad to effect movement of the massage pad by application of fluid pressure thereto.

U.S. Pat. No. 4,313,432 to Sievers sets forth a hand-held massager utilizing pulsing means mounted within the head to vibrate the head of the organization during use.

As such, it may be appreciated that there continues to be a need for a new and improved body massage apparatus wherein the same addresses both the problems of ease of use, as well as effectiveness in construction permitting a manual manipulation of a shower head to direct a water spray through opposed ends of an associated casing simultaneously providing vibration of the casing during use.

SUMMARY OF THE INVENTION

In view of the foregoing disadvantages inherent in the known types of massage apparatus now present in the prior art, the present invention provides a body massage apparatus wherein the same utilizes a cylindrical vibratory housing directing water spray coaxially through each end of the housing for use as a showering and vibratory organization. As such, the general purpose of the present invention, which will be described subsequently in greater detail, is to provide a new and improved body massage apparatus which has all the advantages of the prior art massage apparatus and none of the disadvantages.

To attain this, the present invention provides a body massage apparatus including a cylindrical housing mounting a rigid boss therein, with a rigid conduit extending tangentially aligned with the housing, wherein an eccentrically balanced turbine wheel is mounted within the housing to effect vibration of the housing in use. A top and bottom perforated plate are mounted and secured to the housing orthogonally to the axis defined by the housing. The invention may further include a resilient pad secured to an exterior surface of the housing to enhance use of the organization as a massage apparatus, and further including a pad utilizing massaging tips projecting exterior of the pad.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved body massage apparatus which has all the advantages of the prior art massage apparatus and none of the disadvantages.

It is another object of the present invention to provide a new and improved body massage apparatus which may be easily and efficiently manufactured and marketed.

It is a further object of the present invention to provide a new and improved body massage apparatus which is of a durable and reliable construction.

An even further object of the present invention is to provide a new and improved body massage apparatus which is susceptible of a low cost of manufacture with regard to both materials and labor, and which accordingly is then susceptible of low prices of sale to the consuming public, thereby making such body massage apparatus economically available to the buying public.

Still yet another object of the present invention is to provide a new and improved body massage apparatus which provides in the apparatuses and methods of the prior art some of the advantages thereof, while simultaneously overcoming some of the disadvantages normally associated therewith.

Still another object of the present invention is to provide a new and improved body massage apparatus wherein the same permits manipulation of a shower head directing spray coaxially through each end of the shower head while simultaneously permitting vibration of the shower head to effect massaging of an individual thereby.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
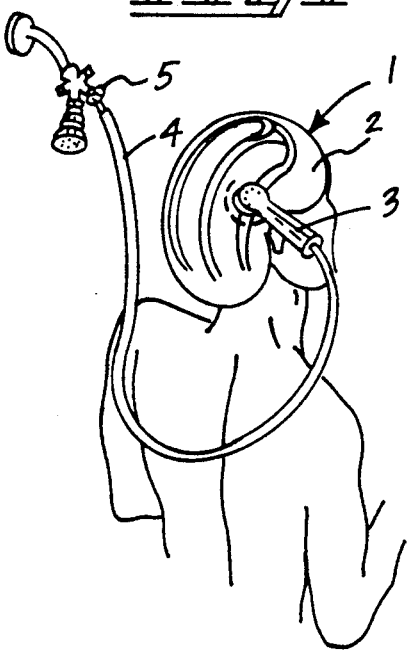
FIG. 1 is an isometric illustration of a prior art massage apparatus.

With reference now to the drawings, and in particular to FIGS. 1 to 9 thereof, a new and improved body massage apparatus embodying the principles and concepts of the present invention and generally designated by the reference numeral 10 will be described.

Figure 2:
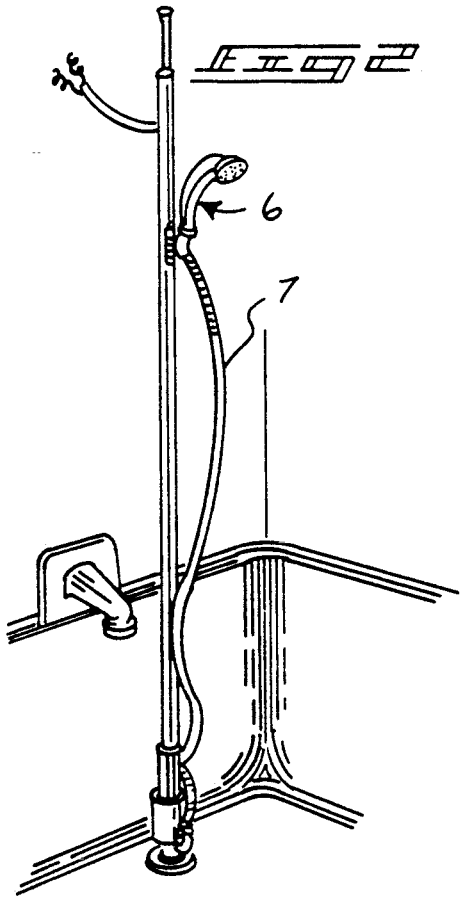
PRIOR ART FIG 2
FIG. 2 is an isometric illustration of a further example of a spray head utilized by the prior art.
Figure 3:
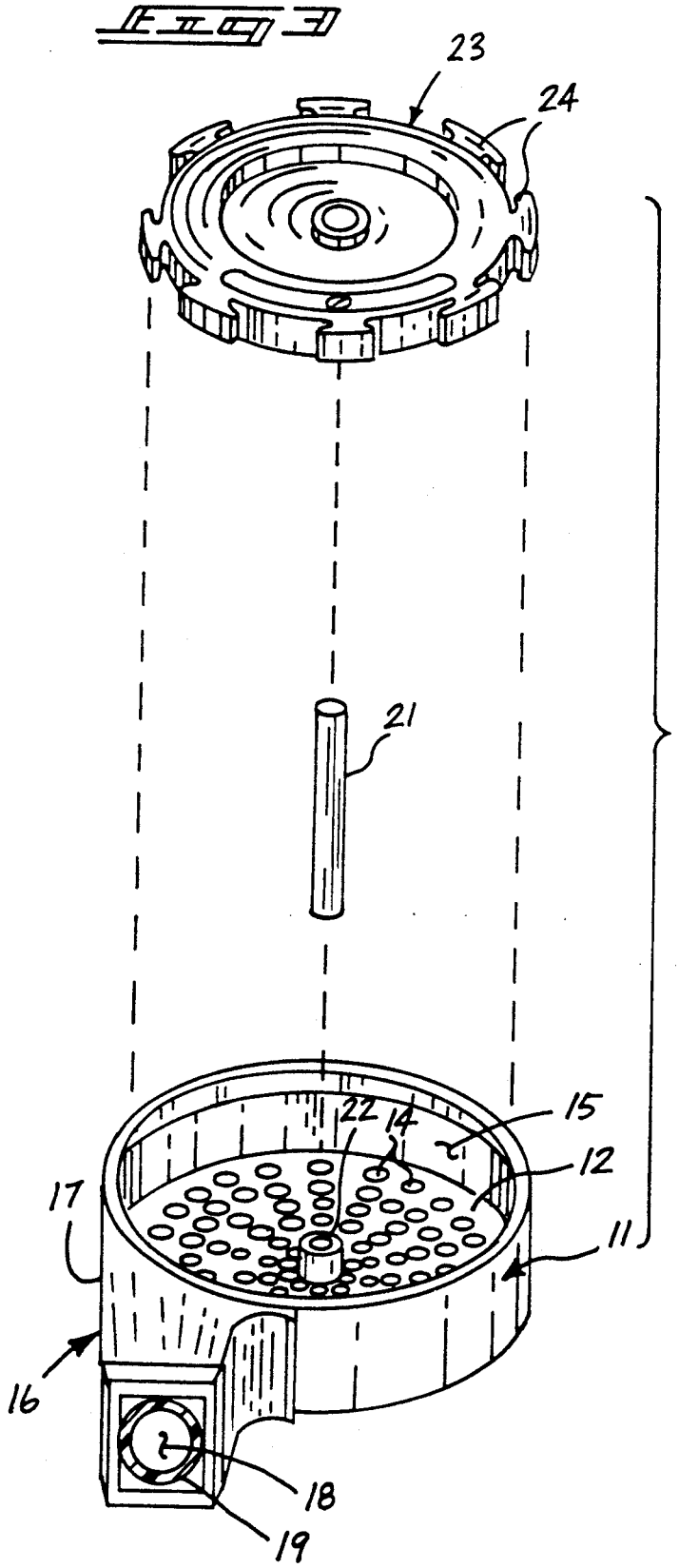
FIG. 3 is an isometric illustration, somewhat exploded, to illustrate the eccentrically weighted turbine wheel mounted within the housing of the instant invention.
Figure 4:
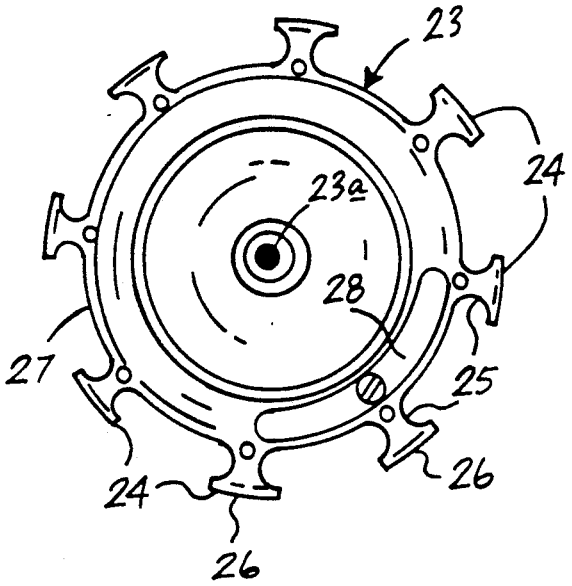
FIG. 4 is an orthographic top view of the turbine wheel utilized by the instant invention.
Figure 5:
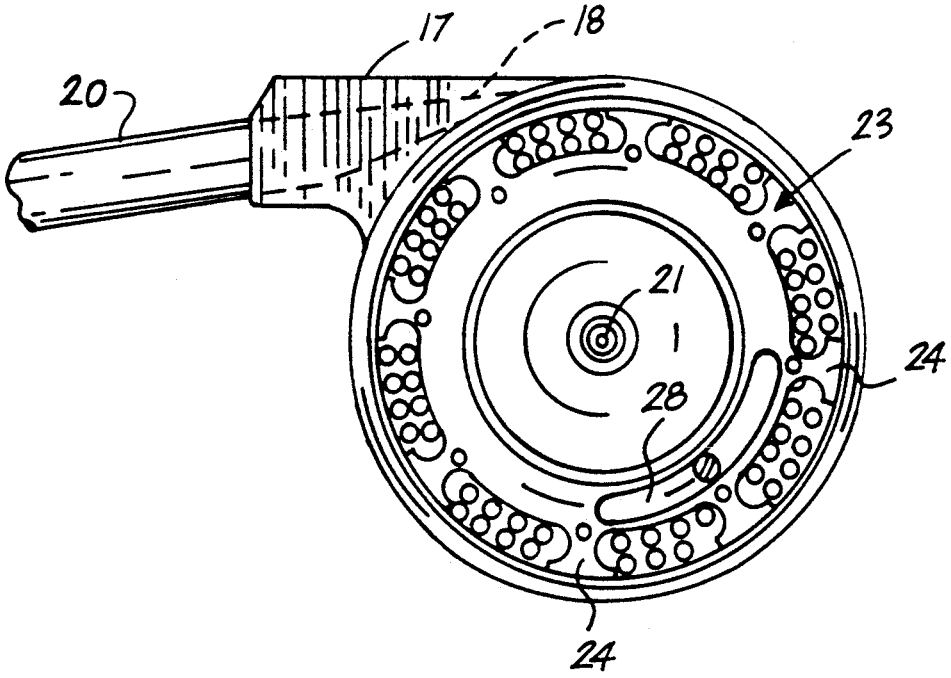
FIG. 5 is an orthographic top view of the turbine wheel mounted within the housing.
Figure 6:
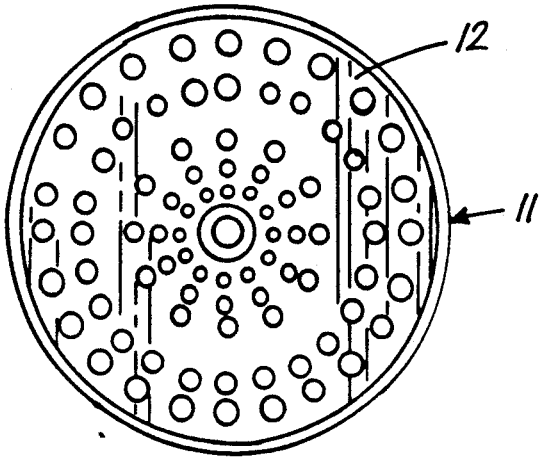
FIG. 6 is an orthographic bottom view of the housing and bottom plate.

FIG. 1 illustrates a prior art scalp massage apparatus 1, wherein a helmet 2 is mounted overlying an individual's head, wherein a hose member 3 is directed within the helmet, including a flexible hose 4 connecting the hose 3 to a water source 5. FIG. 2 illustrates a further prior art showering apparatus 6, wherein a hose 7 is mounted to a pump member 8 positioned within a water outlet portion of a tub enclosure.

Figure 7:
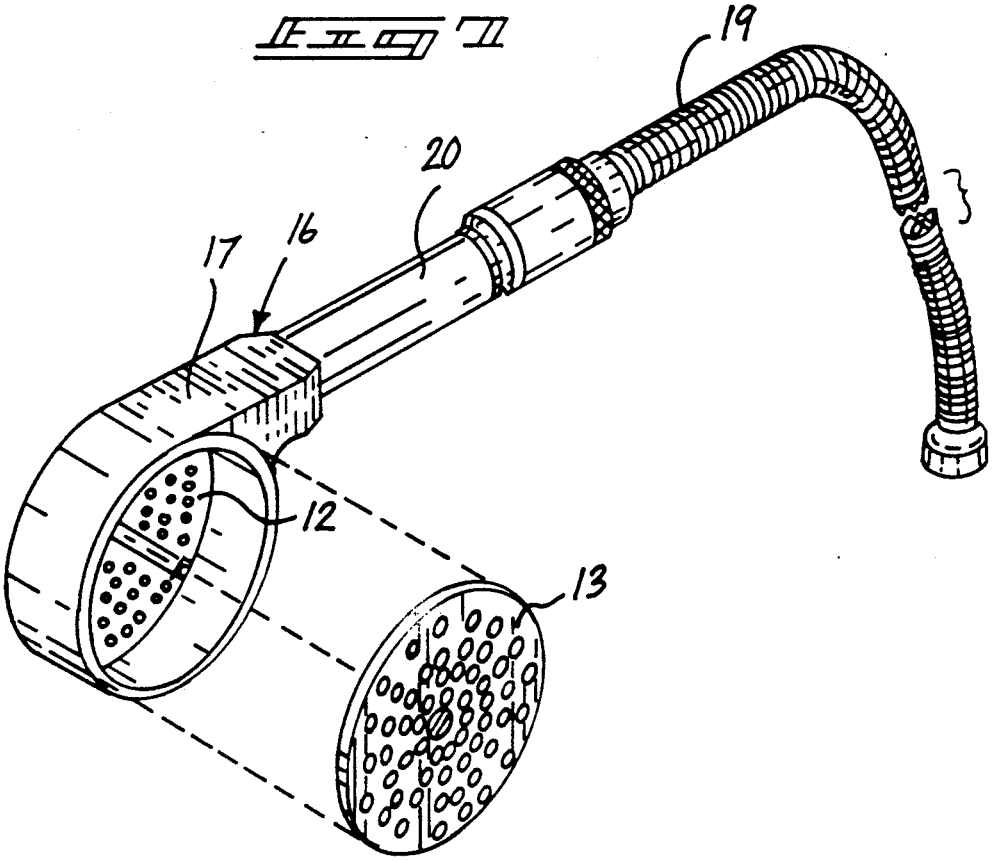
FIG. 7 is an isometric illustration of the top plate mounted overlying the housing cavity for securement thereto.
Figure 8B:
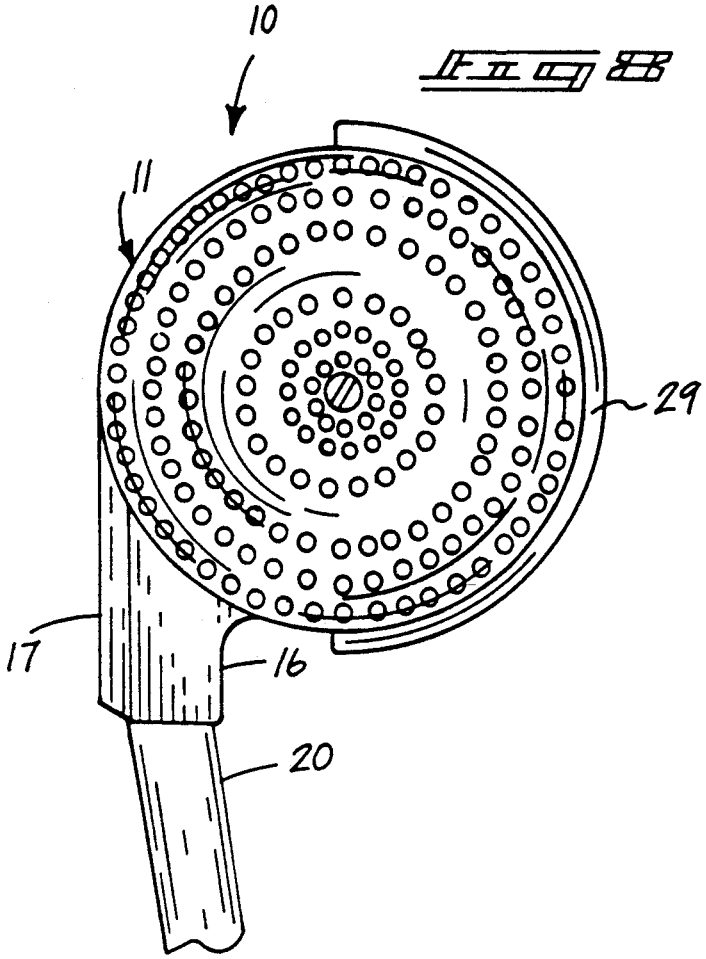
FIG. 8 is an orthographic top view of the instant invention utilizing a vibratory pad mounted thereto.

More specifically, the body massage apparatus 10 of the instant invention essentially comprises a cylindrical housing 11 including an integrally formed bottom wall 12, including a matrix of bottom wall apertures 14 directed therethrough. The bottom wall 12 is fixedly and orthogonally mounted relative to the axis of the housing 11. The axis of the housing 11 includes a sleeve 22 directed interiorly of the housing 11 positioned to fixedly receive an internally threaded axle 21. The internally threaded axle 21 receives a threaded fastener mounted coaxially of a top wall 13, as illustrated in FIG. 7. The top wall 13 is removably mounted overlying the top annular edge of the housing wall of the cylindrical housing 11 to thereby permit waterflow to be directed through the apertures of the bottom and top walls 12 and 13 simultaneously. The cylindrical housing 11 defines a cylindrical housing cavity 15 therewithin formed of a predetermined diameter and a predetermined height. A housing boss 16 integrally formed to the cylindrical housing 11 is tangentially aligned therewith, including a top surface 17 that is tangentially aligned with the exterior surface of the housing 11, including a housing boss venturi conduit 18 directed therethrough. The housing boss venturi conduit 18 is mounted in alignment and fluid communication with a rigid conduit 20 extending tangentially relative to the housing and rearwardly of the housing boss 16. The rigid conduit 20 defines a handle for manual grasping by an individual during use of the organization, wherein a flexible hose 19 extends rearwardly of the rigid conduit 20, with a hose coupling member for securement to a pressurized water source (not shown). The internally threaded axle 21, as noted above, is coaxially aligned within the cylindrical housing and is of a height equal to the predetermined height. An eccentrically weighted turbine wheel 23 is defined by a diameter substantially equal to the predetermined diameter. The turbine wheel 23 includes a cylindrical central hub 27 of a height substantially equal to the predetermined height along with a series of diametrically aligned pairs of "T" shaped turbine blades 24, including arcuate bearing exterior surfaces 26 defining the predetermined height, and including arcuate side surfaces 25 whose sides are parallel to the axis **23*a* of the housing 11. The hub 27 includes an arcuate weight 28 mounted therein defining an arc of substantially twenty to eighty degrees mounted adjacent the peripheral edge of the hub 27 to effect vibration of the cylindrical housing 11, as well as a pulsation of fluid directed exteriorly of the housing from the top and bottom walls 12 and 13**.

Figure 9:
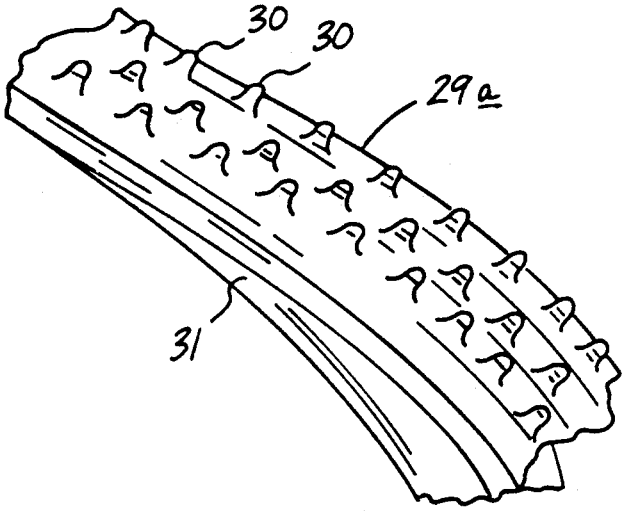
FIG. 9 is an isometric illustration of a vibratory pad utilizing projecting tips utilized by the instant invention.

A resilient massage pad 29 is mounted about an exterior surface of the cylindrical housing 11 in an opposed relationship relative to the housing boss 16 that permits enhanced vibratory application of the housing relative to an individual in use. FIG. 9 illustrates the use of a modified massage pad **29*a*, including a matrix of massaging tips 30 projecting upwardly from a top surface of the modified massage pad 29*a* formed of a relatively flexible resilient material. A peel-away layer 31 is formed throughout and coextensively with a bottom surface of the pad 29*a* to permit securement of the modified pad 29*a* to the massage pad 29 to provide enhanced massaging and vibration to an individual during use. The free terminal ends of the massage pad 29 and the modified massage pad 29*a* when applied to the housing 11 define a diameter substantially parallel to the top boss surface 17** for optimum positioning of the massage pad for application to an individual during use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A body massage apparatus comprising, a cylindrical housing defining a cylindrical housing cavity therewithin, the cylindrical housing including a housing side wall formed with a continuous annular bottom edge and a continuous annular top edge, wherein a bottom wall including a matrix of apertures is fixedly mounted to the bottom edge, and a top wall is removably mounted to the top edge, and a housing boss mounted to the cylindrical housing, wherein the housing boss includes a housing conduit directed therethrough, and a fluid conduit mounted to the housing boss in communication with the housing conduit, and vibratory means mounted within the housing cavity between the bottom wall and the top wall, and wherein the top wall includes a further matrix of apertures directed therethrough, and the bottom wall includes an internally threaded axle mounted fixedly to the bottom wall, with the axle defined by a predetermined height and the housing cavity defined by an equal predetermined height and a predetermined diameter, and the top wall including a threaded member coaxially directed through the top wall and received within the internally threaded axle, and wherein the vibratory means includes a turbine wheel, the turbine wheel defined by a central cylindrical hub, and plural pairs of diametrically aligned "T" shaped turbine blades integrally mounted to the cylindrical hub, the "T" shaped turbine blades defined by arcuate diametrically opposed bearing surfaces, the bearing surfaces of diametrically opposed turbine blades spaced apart a distance equal to the predetermined diameter, and the turbine wheel defined by a height equal to the predetermined height, and wherein the turbine wheel includes an arcuate weight mounted to the hub adjacent the plurality of turbine blades, the arcuate weight defining an arc between twenty and eighty degrees, and wherein the housing boss includes a top boss surface tangentially aligned with the housing, and the housing boss conduit is tangentially aligned to the cylindrical cavity to direct fluid pressure against the "T" shaped turbine blades, and the "T" shaped turbine blades each include a plurality of arcuate side surfaces to receive fluid directed from the housing boss conduit to the arcuate side surfaces, and further including a rigid conduit extending from the housing boss to provide a handle and a flexible hose mounted to the rigid conduit, wherein the flexible hose includes a coupling member mounted to a free end of the flexible hose spaced from the housing boss, and further including a resilient massage pad mounted to an exterior surface of the cylindrical housing, the resilient massage pad defining an arc of 180 degrees and including free terminal ends, the free terminal ends defining a diameter substantially parallel and spaced from the top boss surface, and further including a further massage pad, the further massage pad including a matrix of flexible tips directed upwardly from the top surface of the further massage pad, and a peel-away adhesive layer selectively removable from a bottom surface of the further massage pad to permit securement of the further massage pad to the resilient massage pad.

* * * * *